US007059832B2

(12) United States Patent
Bertrand et al.

(10) Patent No.: US 7,059,832 B2
(45) Date of Patent: Jun. 13, 2006

(54) ROTATION-LOCKING OF SECTORS OF RECTIFIER BLADES BY BARS IN THE PARTING PLANES OF THE HOUSING

(75) Inventors: Jean-Louis Bertrand, Livry-Sur-Seine (FR); Jean-Francois Laurent Chabot, Melun (FR); Leopold Jean-Marie De-Verduzan, Les Ecrennes (FR); Francis Dome, Arcueil (FR); Julien Girardot, Saint Pierre du Perray (FR); Stephanie Pariset, Melun (FR)

(73) Assignee: Snecma Moteurs, Paris (FR)

( * ) Notice: Subject to any disclaimer, the term of this patent is extended or adjusted under 35 U.S.C. 154(b) by 147 days.

(21) Appl. No.: 10/925,996

(22) Filed: Aug. 26, 2004

(65) Prior Publication Data

US 2005/0079047 A1 Apr. 14, 2005

(30) Foreign Application Priority Data

Sep. 10, 2003 (FR) ..... 03 10647

(51) Int. Cl.
*F01D 9/04* (2006.01)

(52) U.S. Cl. ..... 415/209.2; 415/209.3; 415/213.1; 415/214.1

(58) Field of Classification Search ..... 415/209.1, 415/209.2, 209.3, 210.1, 213.1, 214.1
See application file for complete search history.

(56) References Cited

U.S. PATENT DOCUMENTS

| | | | | |
|---|---|---|---|---|
| 5,141,395 | A * | 8/1992 | Carroll et al. | 415/196 |
| 5,846,050 | A * | 12/1998 | Schilling | 415/135 |
| 6,296,443 | B1 * | 10/2001 | Newman et al. | 415/209.2 |

FOREIGN PATENT DOCUMENTS

| | | |
|---|---|---|
| DE | 3341871 A1 | 5/1985 |
| EP | 1 104 836 A2 | 6/2001 |
| EP | 1 308 630 A1 | 5/2003 |
| FR | 2 832 179 A1 | 5/2003 |
| GB | 1009619 | 11/1965 |

* cited by examiner

*Primary Examiner*—Ninh H. Nguyen
(74) *Attorney, Agent, or Firm*—Oblon, Spivak, McClelland, Maier & Neustadt, P.C.

(57) ABSTRACT

The invention relates to a rotation-locking device of a sector of rectifier blades (5) mounted in a sector of the turbojet housing. A sector of blades comprises a support base (3). A housing sector comprises two recesses perpendicular to the axis of the housing, each receiving an edge (34-1, 34-2) of the support base. At one and the same axial end of the housing sector, each recess opens out into a seat (30-1, 30-2) defining an axial face (32-1). The device comprises an axial stop (26) adapting itself on each side in the seats (30-1; 30-1) of the two recesses, and once the complementary sector of the housing is installed and during operation of the turbojet, bearing on the axial faces (32-1) under the thrust of the complementary sector of rectifier blades in order to provide rotation locking.

11 Claims, 4 Drawing Sheets

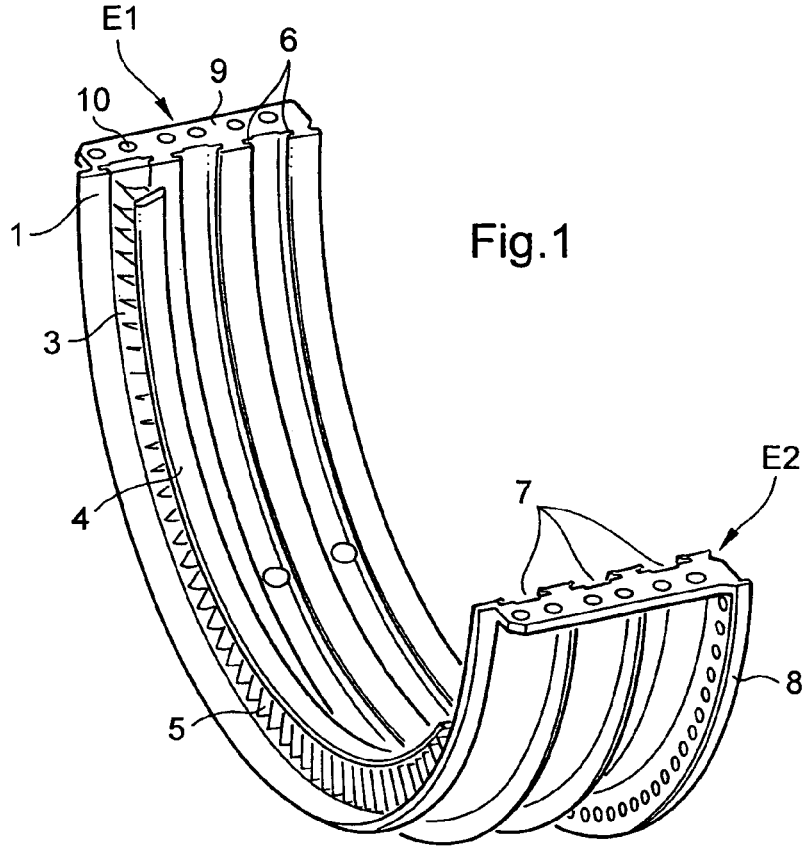
Fig.1
Fig.2
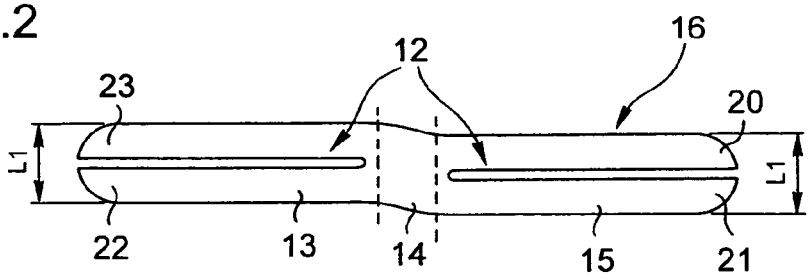
Fig.3
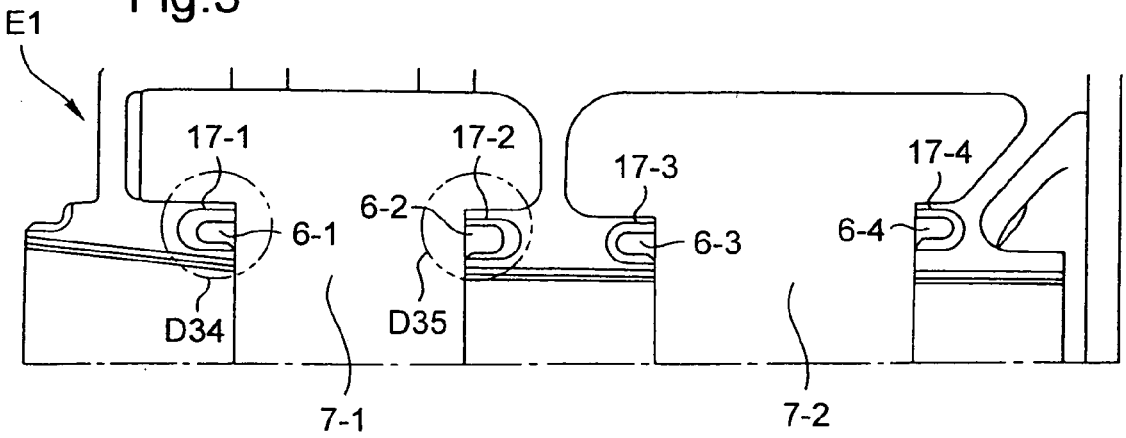

Fig.4
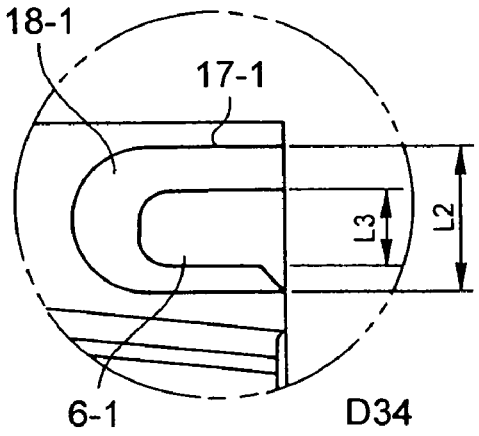
Fig.5
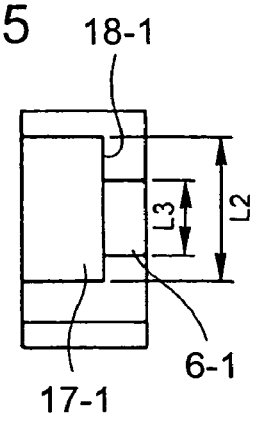
Fig.6
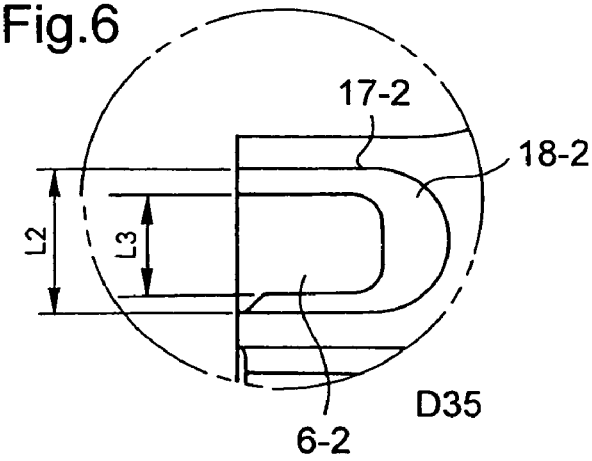
Fig.7
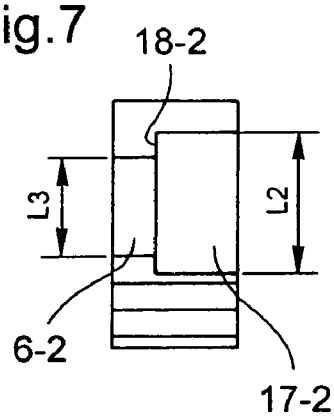
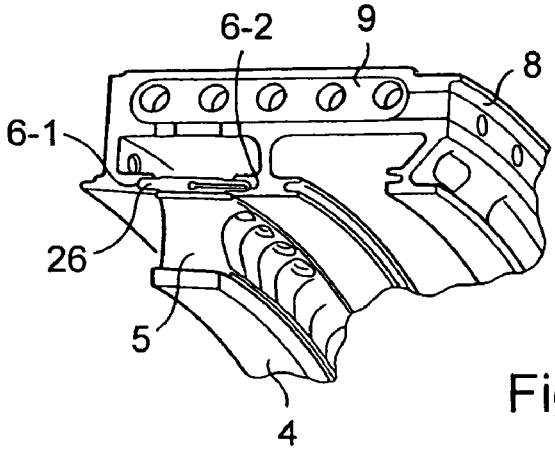
Fig.8

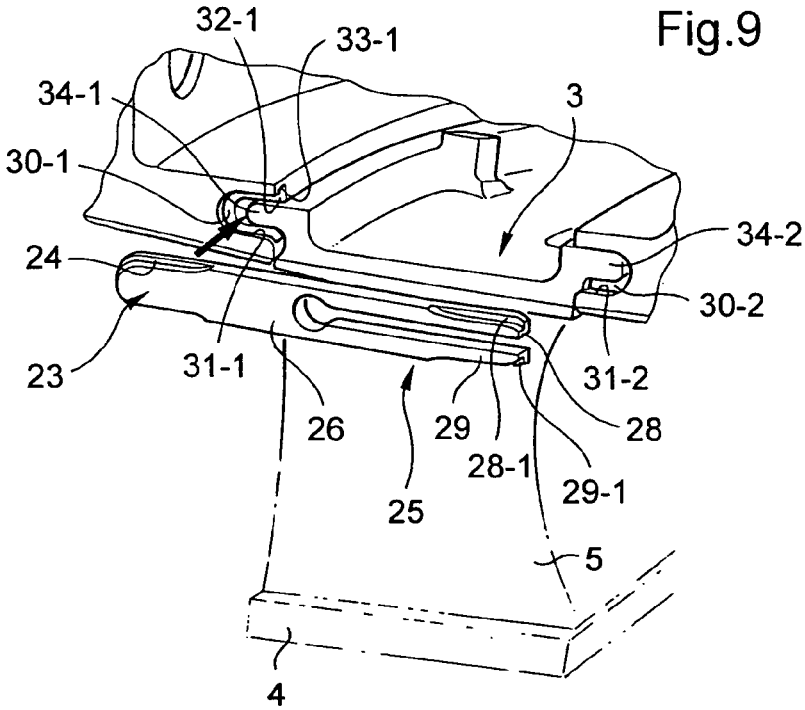
Fig.9
Fig.10
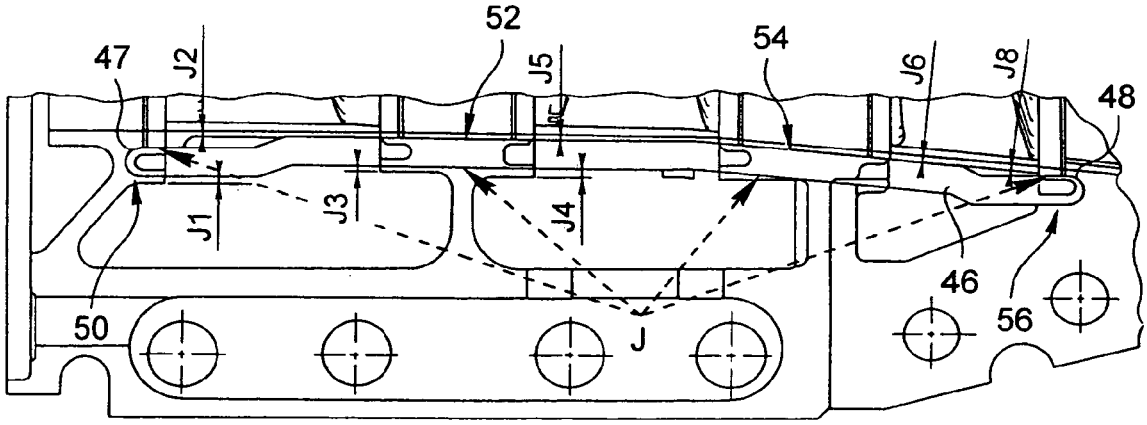
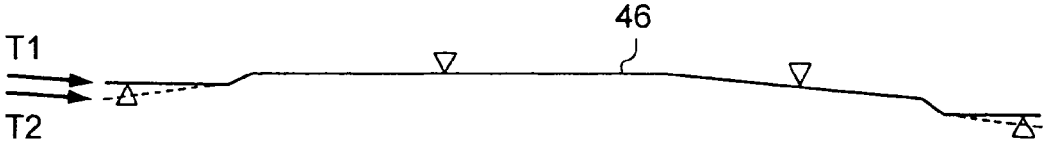
Fig.11

ROTATION-LOCKING OF SECTORS OF RECTIFIER BLADES BY BARS IN THE PARTING PLANES OF THE HOUSING

FIELD OF THE INVENTION

The invention relates to the field of high-pressure turbojet compressors, and more particularly to that of the joint between these sectors of rectifier blades.

BACKGROUND OF THE INVENTION

A high-pressure compressor of a turbojet engine comprises a stator consisting of a housing, which may be in plural sectors, e.g. in two half-shells, in which the hoops of the rectifiers are housed. These hoops are not formed over 360°, but comprise plural sectors of blades. The ends of the sectors of rectifier blades are disposed opposite one another to form a crown of rectifier blades. While the turbojet is in operation, aerodynamic forces due to the pressure differentials between the inner surface and the outer surface of the rectifier blades and forces due to the friction of the moving blades over the abradable faces of the sectors of rectifier blades are applied to the sectors of rectifier blades. These forces drive the rotation of the sectors of blades in their seat, which may straddle the parting plane of the two half-shells of the housing, which prevents dismantling of the same during maintenance work.

In order to prevent rotation of these sectors of blades, it is known to dispose a rod at one end of each of the half-shells, more particularly placed over the entire axial length of the sector and against the ends of the sectors of blades, then to assemble the two half-shells permanently by a bolted joint. This rod acts as a rotation-locking device for the sectors of rectifier blades. However, this device has the disadvantage that the rod tends to get lost during maintenance work.

Also known, from U.S. Pat. No. 5,318,402 are soldered blocks disposed against the ends of the sectors of rectifier blades. This embodiment has the disadvantage of not permitting dismantling of the blocks during maintenance work.

Thus the invention has various embodiments which make it possible in particular to overcome these disadvantages.

SUMMARY OF THE INVENTION

The invention relates to a device for locking in rotation at least one sector of rectifier blades mounted in a sector of the housing of the turbojet engine, each sector of rectifier blades comprising a support base for the blades, the sector of the housing comprising at least two recesses extending in planes perpendicular to the axis of rotation of the turbojet housing and each receiving one edge of the base of the sector of rectifier blades.

According to an essential feature of the invention, at one and the same end of the sector of the housing, in an axial plane, at least two recesses each comprise a seat defining, with the corresponding recess, an axial face of dimensions larger than the dimensions of the recess cross-section.

According to another essential feature of the invention, the rotation-locking device comprises a stop positioned so as to extend axially, adapting itself on one side in the seat of one of the recesses and on the other side in the seat of the other recess and, after installation of the complementary housing sector and during operation of the turbojet, coming into contact with the axial face of each seat under the thrust of at least one complementary sector of rectifier blades in order to lock in rotation at least one sector of blades, the stop being either rigidly connected to the sector of blades or being a bar comprising at least one end with a longitudinal slot for resilient mounting and holding in the seats.

According to a first embodiment of the invention, the bar comprises two ends of radial dimensions larger than those of the corresponding seats, the bar having a longitudinal slot at each end.

According to a second embodiment of the invention, the bar extends from the seat of a first recess to the seat of a second recess which is axially non-adjacent, the bar bearing on at least two intermediate recesses and forming a stop for at least two axially adjacent sectors of blades.

According to a third embodiment of the invention, the bar bears on four intermediate recesses and forms a stop for three axially adjacent sectors of blades.

Advantageously, the bar comprises plural parts which extend axially.

According to a fourth embodiment of the invention, the stop rigidly connected to the sector of blades comprises a stop formed integrally with the base of the sector of blades and positioned at the end of the sector of blades.

By way of modification, the stop rigidly connected to the sector of blades comprises a stop soldered to the base of the sector of blades and positioned at the end of the sector of blades.

Preferably, the stop comprises a first stop element corresponding to the seat of a first recess and a second stop element corresponding to the seat of a second recess.

According to a fifth embodiment of the invention, each seat comprises a groove of specified width extending axially and being defined, on the side of the recess, by an axial face of dimensions larger than those of the cross-section of the recess and, on the side of the end of the housing sector, by an axial face capable of holding the bar once this is installed in the seat.

These various embodiments have the particular advantage of permitting the stop to be held in place under any circumstances: during operation of the turbojet, and during maintenance work for example.

Moreover, most of these embodiments make it possible to prevent fluid leaks between the stages of rectifiers.

BRIEF DESCRIPTION OF THE DRAWINGS

The attached drawings show in a non-limiting manner embodiments according to the invention, as follows:

FIG. 1, a three-dimensional view of a half-shell of a sector of the housing of a turbojet equipped with a sector of rectifier blades.

FIG. 2 shows an axial section, in the parting plane of the half-shells, of a bar forming part of the rotation-locking device according to the invention, FIG. 3 shows an axial section, in the parting plane of the half-shells, of an end of the hoop sector of the turbojet housing comprising part of the rotation-locking device according to a first embodiment of the invention, FIG. 4 shows a detail D34 of the rotation-locking device of FIG. 3, FIG. 5 shows a detail of the right-hand part according to FIG. 4, FIG. 6 shows a view of the detail of the rotation-locking device of FIG. 3, FIG. 7 shows a detail of the left-hand part of FIG. 6, FIG. 8 shows a three-dimensional view of a half-shell of the turbojet housing comprising the rotation-locking device according to a second embodiment of the invention, in particular the bar according to the third embodiment of the rotation-locking device, FIG. 9 shows a detailed three-dimensional view of the bar according to the second embodiment of the invention before installation on the end of the hoop sector of the turbojet housing comprising a part of the rotation-locking device according to the second embodiment of the invention, FIG. 10 shows a plan view of one end of a half-shell of the turbojet housing comprising the rotation-locking device according to a third embodiment of the invention, in particular the bar according to the third embodiment of the rotation-locking device, FIG. 11 shows a diagrammatic view of the bar showing the bearing points thereof with the end of the hoop sector of the turbojet housing according to the third embodiment of the invention.

DETAILED DESCRIPTION OF EMBODIMENTS OF THE INVENTION

Figure 12:
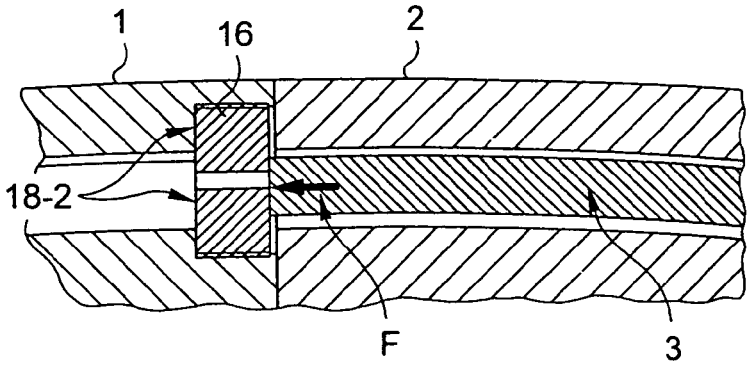
FIG. 12 shows a partial transverse section of the rotation-locking device of the sector of blades in operation.

The drawings contain essentially elements of a specific nature. They may therefore not only help to explain the invention, but also to define it if necessary.

FIG. 1 shows a sector 1 of the housing of a turbojet capable of being fixed to a complementary sector to form the full housing. This sector of semi-cylindrical shape, known as a half-shell and having for an axis the axis of rotation of the turbojet, has two ends E1 and E2, each equipped with a flange 9 adapted to come into contact with a flange of the complementary sector. These flanges 9 are equipped with holes 10 positioned opposite the holes of the flange of the complementary sector so as to fix the two complementary sectors together. Each hoop sector also has a semicircular flange 8 equipped with holes. Once assembled, the two sectors forming a full housing, the flanges 8 of the two sectors are placed in contact with the complementary flanges of another housing of the turbojet. The housings are assembled together by fixing means penetrating the holes in the flanges placed together, e.g. by bolts. Each housing sector 1 comprises plural semicircular grooves 7 open towards the inside of the housing, each being adapted to receive a sector of rectifier blades.

A crown of rectifier blades is formed of at least two sectors of rectifier blades each positioned in one of the two housing sectors, the ends of the sectors of blades being opposite one another. One sector of rectifier blades has a cylindrical base 3 which is radially exterior, known as the outer platform. This cylindrical base 3 supports the rectifier blades 5 fixed together by a radially inner cylindrical base 4 known as the inner platform. Each groove 7 of the housing sector 1 is equipped with two circular recesses 6, such that each receives one of the two edges of the outer platform of the sector of rectifier blades.

During operation of the turbojet, aerodynamic forces are applied to these sectors of rectifier blades and are due to the friction of the moving blades of the rotor over the inner platforms 4 of the sectors of rectifier blades formed of abradable materials. The rotation of the sectors of blades makes it impossible to dismantle the housing sectors during maintenance work.

In order to stop rotation of these sectors of blades, it is known to dispose a rod at one of the ends E1 or E2 against the flanges 9, the rod being placed more particularly over the entire axial length of the flanges 9 and against the ends of the outer platforms of the sectors of blades, then to assemble the two sectors of the housing 1 rigidly together. This bar thus performs the task of blocking rotation of the sectors of rectifier blades. However, this device has the disadvantage that the bar tends to get lost during maintenance. Moreover, fluid may get between plural stages of the compressor.

Thus the invention presents various embodiments which will make it possible to overcome at least some of these disadvantages.

FIGS. 2 to 7 show a first embodiment of the invention.

FIG. 2 shows a longitudinal bar 16 capable of being positioned axially at the end of the hoop sector. In a more detailed manner, this bar 16 has a first longitudinal end 13 followed by a crank 14, then by a second longitudinal end 15. The first and second ends are each equipped with a longitudinal slot 12. The slot 12 of the end 13 of the bar defines a first end arm 23 and a second end arm 22 on either side of the slot 12. At the end 15 of the bar, a first end arm 20 and a second end arm 21 are defined on either side of the slot 12. The width of each end of the bar in the unstressed state is referenced L1.

This bar 16 is adapted to be installed once a sector of rectifier blades is disposed in a hoop sector of the turbojet housing.

FIG. 3 shows an end E1 of a hoop sector of the turbojet housing. Each groove 7-1, 7-2 of the end of the hoop sector comprises two semicircular recesses 6-1 and 6-2, 6-3 and 64 positioned opposite one another. The depth of each recess extends axially. Each of the two recesses receives a semicircular edge of an outer platform of a sector of rectifier blades. Each semicircular recess ends at least at one of its ends with a seat 17-1-, 17-2, 17-3, and 17-4 of dimensions larger than those of the corresponding recess. The ends 13 and 15 of the bar 16 are adapted to be installed in the seats 17-1 and 17-2 respectively.

The ends D34 of the recess 6-1 and D35 of the recess 6-2 are more specifically detailed in FIGS. 4 and 5, and FIGS. 6 and 7 respectively.

FIG. 4 shows the respective dimensions of the recess 6-1 and of the corresponding seat 17-1. FIG. 5 is a view of the right-hand side of FIG. 4. The semicircular recess 6-1 has a radial dimension, i.e. a recess height L3 and opens at its end into a seat 17-1 of radial dimension L2 larger than L3. Thus, the seat 17-1 defines an axial contact face 18-1 extending axially and radially beyond the depth and the height of the recess.

FIG. 6 shows the end D35 of the semicircular recess 6-2 opposite the semicircular recess 6-1. This semicircular recess 6-2 of radial dimension L3 ends with a seat 17-2 of radial dimension L2 larger than L3. This seat 17-2 defines an axial contact face 18-2 extending axially and radially beyond the depth and height of the recess.

Obviously, the opposing recesses may have different dimensions from one another.

FIG. 7 shows a view of the left-hand side of FIG. 6.

Once a sector of rectifier blades is installed in the recesses 6-1 and 6-2, the end arms 23, 22 and 20, 21 respectively of the bar are brought together by squeezing. The ends 13 and 15 are installed respectively in the seats 17-1 and 17-2 so that the end arms 23, 22 and 20, 21 respectively meet the contact face 18-1 and 18-2 respectively. The end arms may then be released. The dimension L1 corresponding to the width of an end of the released bar must be equal to or larger than the dimension L2 corresponding to the radial dimension (or width) of the corresponding seat. Thus the bar 16 is held resiliently by each of its ends in the corresponding seats. When the end arms are brought together by squeezing, each end of the bar must have a width L smaller than the dimension L2 of the corresponding seat so as to be able to insert the end in the seat, which is known as resilient mounting.

Obviously, the seats 17-1 and 17-2 may have different radial and axial dimensions, and the same applies to the ends 13 and 15 of the bar 16 inserted into these seats.

Figure 13:
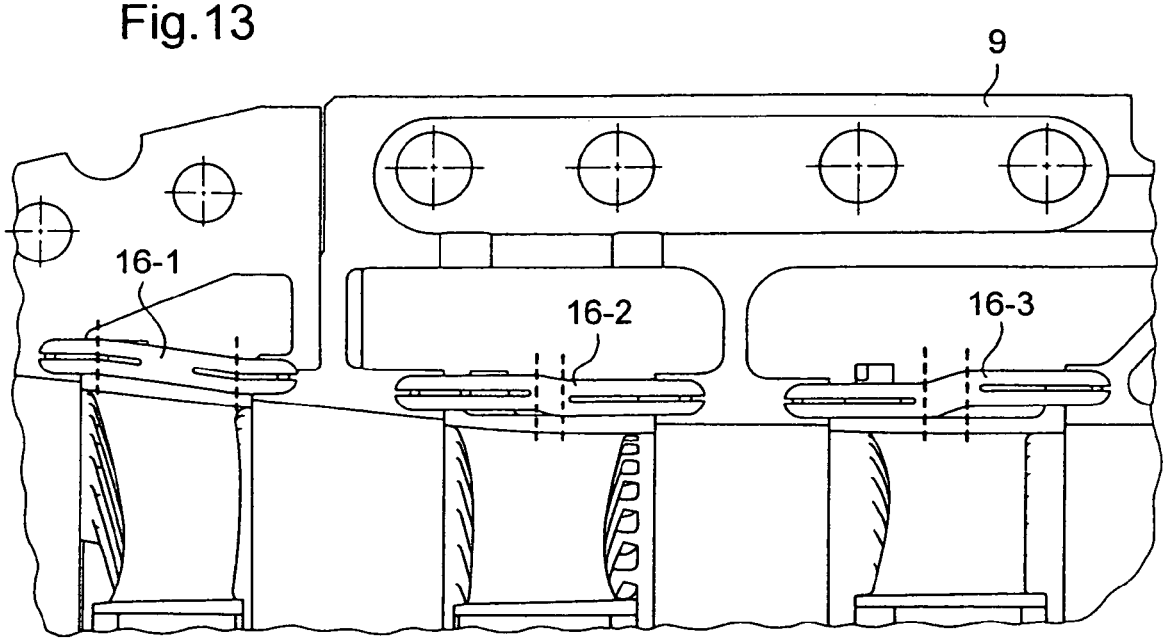
FIG. 13 shows a plan view of one end of a half-shell of the turbojet housing comprising the rotation-locking devices according to the first embodiment of the invention, in particular the bars according to the first embodiment of the rotation-locking device.

FIG. 13 shows three sectors of rectifier blades installed in a sector of the housing, locked in rotation by rotation devices comprising seats at the end of the semicircular recesses and the bars 16, whose ends are inserted into these seats, come into abutment with the contact face of these seats and are held resiliently by the pressure of the end arms against the faces perpendicular to the contact face of these seats. It should be noted that according to the radial position of the semicircular recesses and of the corresponding end seats, the bars 16 comprise a cranked portion of larger or smaller longitudinal dimension. In general, the greater the radial distance between two opposing seats, the greater the longitudinal dimension of the cranked portion. It should be noted that the bar 16-1 has a relatively large cranked portion. The slots 12 of this bar extend along the ends of the bar up to part of the cranked portion.

FIG. 12 shows a partial section in a transverse plane of the assembly of one housing sector 1 to a housing sector 2 at the level of the rotation-locking device of the sectors of rectifier blades.

During operation, the bar 16 is pushed against the axial contact face 18-2 by the base 3 of the sector of rectifier blades, which exerts a pressure force F on the axial face of the bar 16 parallel to the axial face of the bar placed in contact with the axial contact face 18-2.

Figure 14:
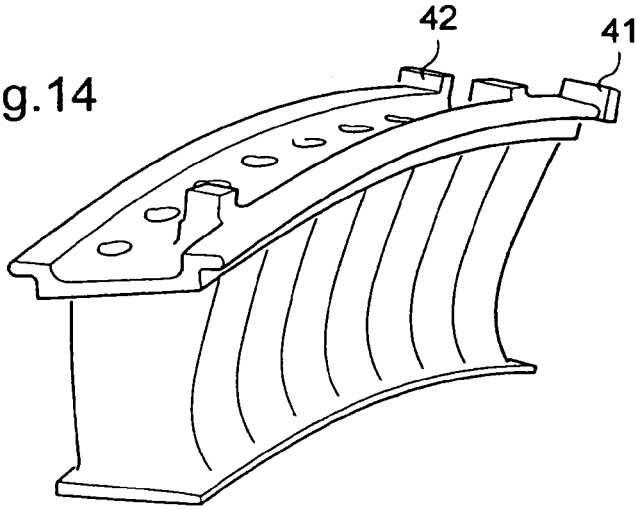
FIG. 14 shows a three-dimensional view of a sector of rectifier blades comprising part of the rotation-locking device according to a fourth embodiment of the invention.

FIG. 14 shows a second embodiment of the invention.

The rotation-locking device comprises seats disposed at the end of the semicircular recesses of the hoop sector of the turbojet housing and a stop disposed at the end of the sector of rectifier blades. As is shown in FIG. 14, this stop can be formed integrally with the outer platform of the sector of rectifier blades or can be soldered to this platform. Solely by way of example, FIG. 14 shows a stop comprising a stop disposed on a transverse edge of the outer platform of the sector of rectifier blades, this stop comprising a first portion 41 disposed at one end of the transverse edge and a second portion 42 disposed at the other end of the transverse edge. These first and second portions 41 and 42 have a radial dimension (or height) smaller than or equal to the radial dimension L2 of the seat shown in FIGS. 4 to 7 and larger than or equal to the radial dimension L3 of the corresponding semicircular recess. In this embodiment the stop is integral with the sector of rectifier blades, which avoids loss of the same during maintenance involving dismantling of the housing sectors. This embodiment also makes it possible to avoid a fluid leak between the stages of the turbojet.

FIGS. 8 and 9 show a third embodiment of the invention.

FIG. 8 shows a three-dimensional view of the end of a sector of housing. This end comprises flanges 9 and 8 as described above. A sector of rectifier blades is shown having been slid into the opposing recesses 6-1 and 6-2. This sector has the blades 5 and an inner platform 4. The rotation-locking device of the sector of rectifier blades has a bar 26 disposed in the adapted seats. This device is more particularly detailed in FIG. 9.

In FIG. 9, the outer platform 3 of the sector of rectifier blades has axially on its edges semicircular hooks 34-1 and 34-2 of radial dimensions (or height) and axial dimensions smaller than the dimensions (height and depth) of the recesses 6-1 and 6-2 so that these hooks can slide in the corresponding recesses.

The recess 6-1, 6-2 ends with a seat 30-1, 30-2. The seat 30-1 defines a groove extending in an axial plane (plane passing through the axis of rotation), the groove having a base face 33-1 encased on the side of the semicircular recess by an axial face 32-1 and, opposite this face, by an axial face 31-1. The seat 30-2 is formed in equivalent manner axially opposite the housing 30-1. These axial faces 31-1, 31-2 and 32-1 respectively have larger dimensions than the cross-section of the corresponding recess.

The bar 26 has a first end 23 and a second end 25, the latter having an open-ended longitudinal slot. On either side of this slot, a first end arm 28 and a second end arm 29 are defined.

The end 23 of the bar 26 has a thickness greater than the width of the base of the groove 33-1. So as to slide the end 23 of the bar in the groove of the seat 30-1, this end 23 is equipped at its periphery with a shoulder defined by an axial face 24 adapted to come into contact with the axial face 31-1 of the groove of the seat 30-1 in order to act as a stop. In the same manner, the end arms 28 and 29 are equipped at their outer periphery with a shoulder defined in particular by an axial face 28-1 and 29-1 respectively adapted to come into contact with the face 31-2 of the groove of the housing 30-2 in order to act as a stop. For installation of the bar, the end arms 28 and 29 are brought together by squeezing, the end 23 is slid into the groove of the housing 30-1, and the end 25 is inserted into the groove of the seat 30-2. Once inserted in the seat 30-2, the two end arms 28 and 29 are released so that the axial faces 28-1 and 29-1 are in contact with the axial face 31-2 of the groove of the seat 30-2. The seats 30-1 and 30-2 thus define the contact faces 32-1 and 31-1, 31-2 with the bar 26, the latter being stopped in one rotational direction and bearing in the other rotational direction on these contact faces. It should be noted that the radial dimension of the end 25 of the bar when the end arms 28 and 29 are brought into contact by squeezing is less than the radial dimension of the aperture of the seat 30-1, 30-2. Thus the end 25 of the bar can be inserted into the groove of the seat 30-2 after squeezing together of the end arms 28 and 29.

This embodiment makes it possible to keep the bar in the seats.

It is equally possible to form a groove of sufficient width to receive the thickness of the end of the bar without having to form a shoulder thereon.

FIGS. 10 and 11 show a fourth embodiment of the invention.

In this embodiment, the bar 46 has two ends 47 and 48 as are defined in the first embodiment. Thus each end 47, 48 comprises a longitudinal slot adapted to be installed in a seat according to the embodiment of FIG. 3. This bar 46 has a length such that it extends from a first seat corresponding to a first sector of rectifier blades to a second opposite seat corresponding to a third sector of rectifier blades. Thus a single bar is used, correspondingly to suitable seats, as a rotation-locking device for plural sectors of rectifier blades. The intermediate recesses between the first seat receiving one end of the bar and the second seat receiving the second end of the bar have no seat, but rather a groove in which the bar locates. The bar 46 is configured in plural interconnected parts by the connection of parts in such a manner that the ends of the semicircular recesses disposed in the various radial positions open on to a portion of the bar 46. These parts are configured to be in contact with elements of the housing at certain points of the bar 46, e.g. at the contact points 50, 52, 54, 56. However, there is clearance between the bar and the housing, e.g. the clearances J, J1 to J8, leaving space for liquid leaks between the stages of the compressor rectifiers.

FIG. 11 shows diagrammatically the bar 46 shown by a continuous line when it is in a state T1, i.e. when it is inserted into the corresponding seats. The triangles represent the points of contact of the bar with the housing. When the bar 46 is removed from the corresponding seats, it is in a free state in state T2.

In all the embodiments, the stop (bar or stop fixed to the sector of blades) of the rotation-locking device of the rectifier sector has the advantage of not getting lost during dismantling of the hoop sectors of the turbojet.

The invention is not limited to the embodiments of the rotation-locking device described above purely by way of example, but extends to all modifications conceivable by the person skilled in the art.

What is claimed is:

1. Rotation-locking device for at least one sector of rectifier blades mounted in a sector of the housing of a turbojet, each sector of rectifier blades comprising a base for supporting the blades, the sector of the housing comprising at least two recesses which extend in planes perpendicular to the axis of rotation of the turbojet housing and each of which receives an edge of the base of the sector of rectifier blades, characterised in that at one and the same end of the sector of the housing, in an axial plane, at least two recesses each comprise a seat defining, with the corresponding recess, an axial face of dimensions larger than the dimensions of the recess cross-section, and in that the rotation-locking device comprises a stop positioned so as to extend axially, adapting itself on one side in the seat of one of the recesses and on the other side in the seat of the other recess and, after installation of the complementary housing sector and during operation of the turbojet, coming into contact with the axial face of each seat under the thrust of at least one complementary sector of rectifier blades in order to lock in rotation at least one sector of blades, the stop being either rigidly connected to the sector of blades or being a bar comprising at least one end with a longitudinal slot for resilient mounting and holding in the seats.

2. Device according to claim 1, characterised in that the bar comprises two ends of radial dimensions larger than those of the corresponding seats, the bar comprising a longitudinal slot at each end.

3. Device according to claim 1, characterised in that the bar extends from the seat of a first recess to the seat of a second recess which is axially non-adjacent, the bar bearing on at least two intermediate recesses and forming a stop for at least two axially adjacent sectors of blades.

4. Device according to claim 1, characterised in that the bar extends from the seat of a first recess to the seat of a second recess which is axially non-adjacent, the bar bearing on four intermediate recesses and forming a stop for three axially adjacent sectors of blades.

5. Device according to claim 1, characterised in that the bar comprises plural portions extending axially.

6. Device according to claim 1, characterised in that the stop rigidly connected to the sector of blades comprises a stop formed integrally with the base of the sector of blades and positioned at the end of the sector of blades.

7. Device according to claim 1, characterised in that the stop rigidly connected to the sector of blades comprises a stop mounted by soldering to the base of the sector of blades and positioned at the end of the sector of blades.

8. Device according to claim 1, characterised in that the stop rigidly connected to the sector of blades comprises a stop formed integrally with base of the sector of blades and positioned at the end of the sector of blades and in that the stop comprises a first stop element corresponding to the seat of a first recess and a second stop element corresponding to the seat of a second recess.

9. Device according to claim 1, characterised in that the stop rigidly connected to the sector of blades comprises a stop mounted by soldering to the base of the sector of blades and positioned at the end of the sector of blades and in that the stop comprises a first stop element corresponding to the seat of a first recess and a second stop element corresponding to the seat of a second recess.

10. Device according to claim 1, characterised in that each seat comprises a groove of specified width extending axially and being defined on the side of the recess by the axial face of dimensions larger than the dimensions of the recess cross-section and, on the side of the end of the housing sector, by an axial face capable of retaining the bar once the same has been installed in the seat.

11. Turbojet comprising the rotation-locking device according to claim 1.

* * * * *